US005877795A

United States Patent [19]

Gragg et al.

[11] Patent Number: 5,877,795

[45] Date of Patent: Mar. 2, 1999

[54] METHODS AND DESIGNS TO PURGE AIR FROM INK TUBES DURING INITIAL STARTUP

[75] Inventors: Brian D. Gragg, San Diego; B. Michael Eckard, Cardiff; Michael F. Bilotta, San Diego, all of Calif.

[73] Assignee: Hewlett-Packard Co., Palo Alto, Calif.

[21] Appl. No.: 655,573

[22] Filed: May 24, 1996

[51] Int. Cl.[6] ..... B41J 2/19; B41J 2/175

[52] U.S. Cl. ..... 347/92; 347/86

[58] Field of Search ..... 342/92, 84, 86, 342/85; 347/92, 84, 85, 86, 93

[56] References Cited

U.S. PATENT DOCUMENTS

| | | | |
|---|---|---|---|
| 4,432,005 | 2/1984 | Duffield et al. | 346/140 R |
| 4,437,104 | 3/1984 | Hudson | 346/140 R |
| 4,593,294 | 6/1986 | Parisi | 342/92 |
| 4,831,389 | 5/1989 | Chan | 346/140 R |
| 5,280,300 | 1/1994 | Fong | 347/86 |
| 5,367,328 | 11/1994 | Erickson | 347/7 |
| 5,500,664 | 3/1996 | Suzuki | 347/86 |
| 5,506,611 | 4/1996 | Ujita | 347/86 |
| 5,710,579 | 1/1998 | Hahs et al. | 347/98 |

FOREIGN PATENT DOCUMENTS

| | | | |
|---|---|---|---|
| 0734867 | 10/1996 | European Pat. Off. | B41J 2/175 |
| 4434186 | 3/1996 | Germany | B41J 2/175 |
| WO96/34753 | 11/1996 | WIPO | B41J 2/165 |

OTHER PUBLICATIONS

Copy of EPO Search Report, dated Aug. 25, 1998, from application EP 97 30 3110.

*Primary Examiner*—Benjamin R. Fuller
*Assistant Examiner*—Thien Tran
*Attorney, Agent, or Firm*—Manuel Quoigue

[57] ABSTRACT

An ink jet carriage assembly for an off-axis ink delivery ink jet printer including a movable print carriage; a plurality of ink jet printhead cartridges removably supported by the movable print carriage having cartridge septums for accepting respective ink delivery needles; a humidor structure located adjacent the cartridge septums for collecting ink from ink delivery needles when air is purged from ink delivery tubes connected to the ink delivery needles, and for containing or enclosing the ink delivery needles to prevent ink evaporation from the ink delivery tubes. A dummy cartridge collects ink from an ink delivery connector when air is purged from an ink delivery tube connected to the ink delivery connector.

12 Claims, 5 Drawing Sheets

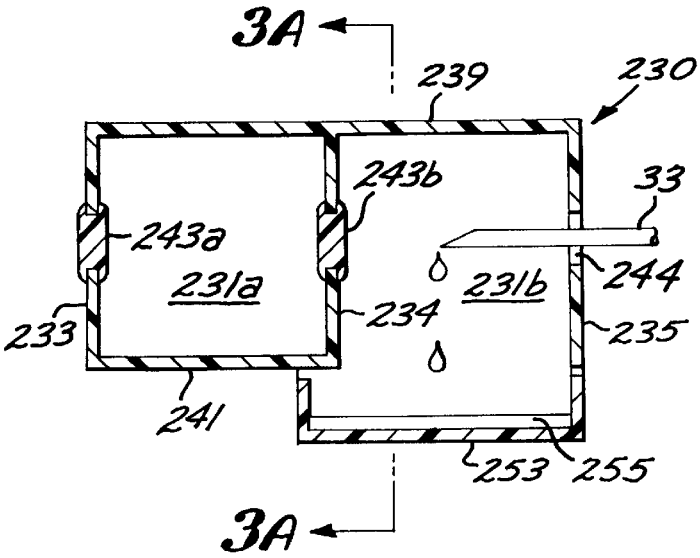
FIG. 3B
FIG. 2B
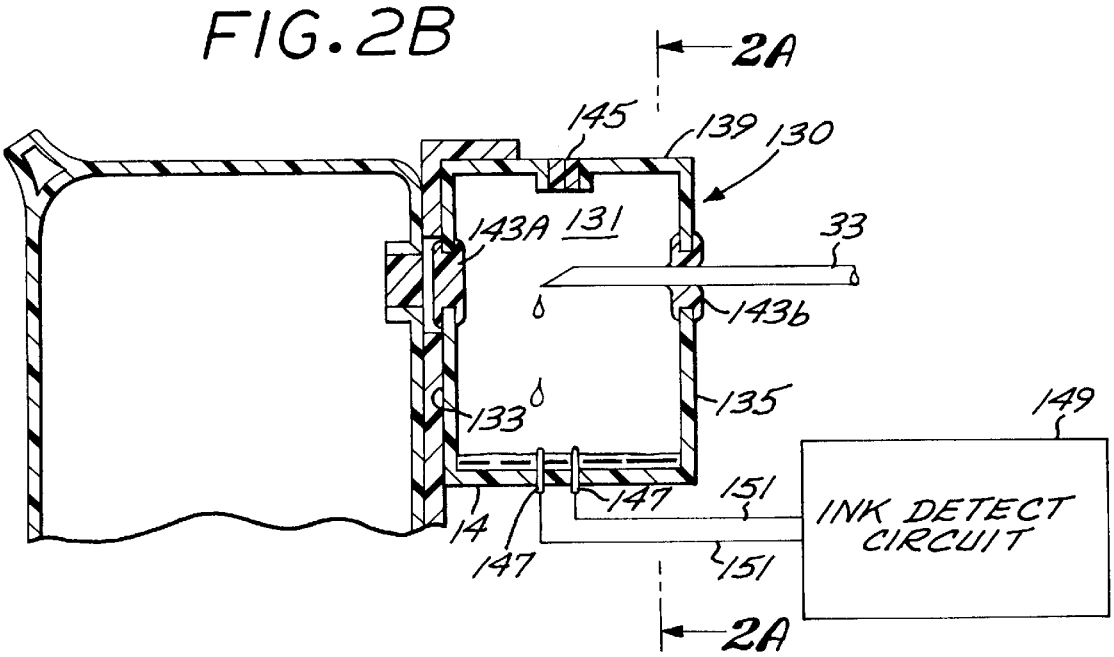

FIG. 6
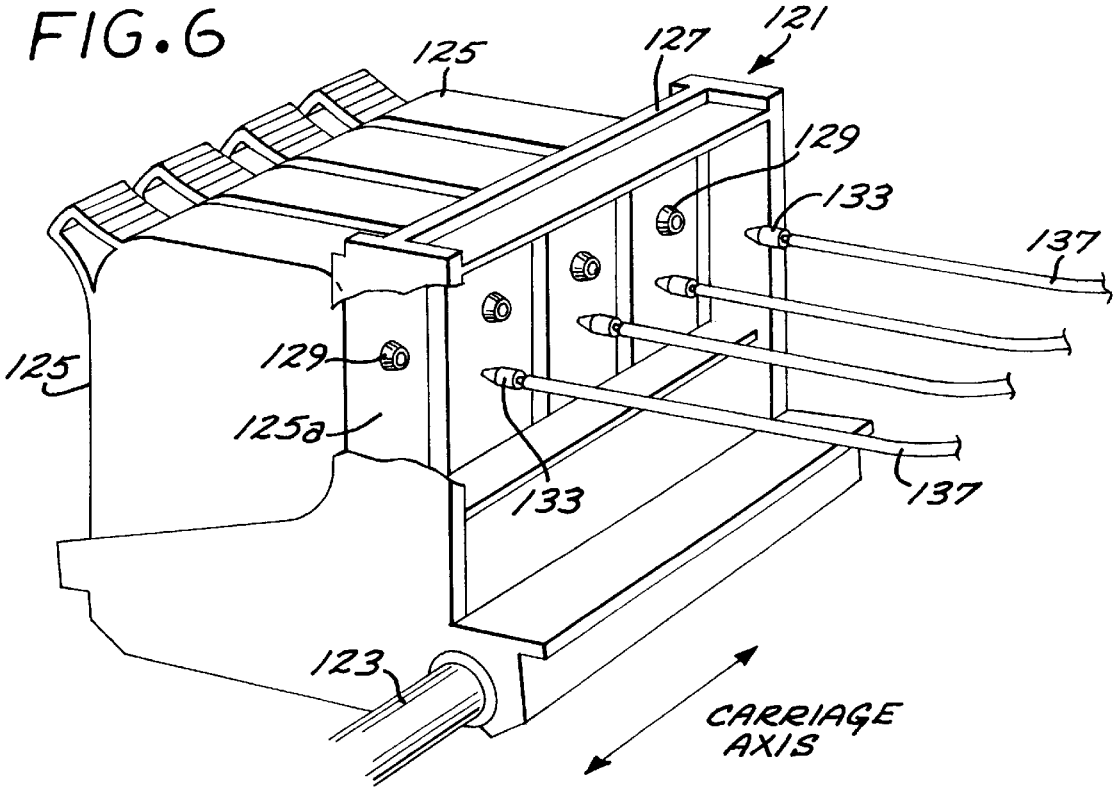
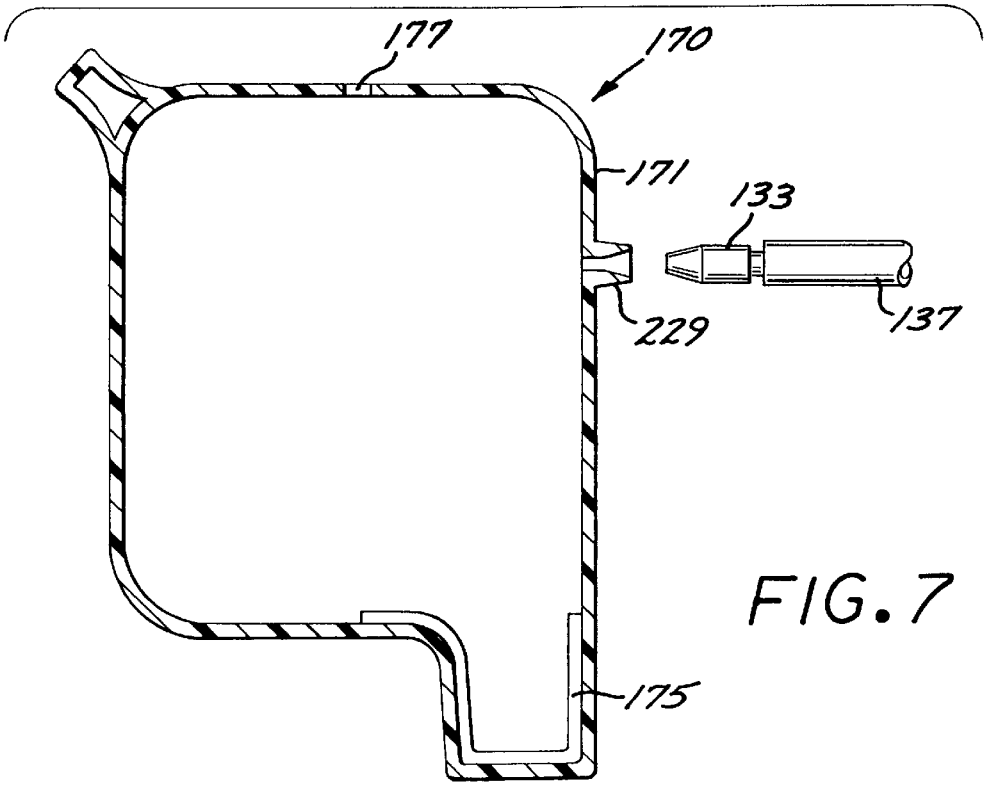
FIG. 7

METHODS AND DESIGNS TO PURGE AIR FROM INK TUBES DURING INITIAL STARTUP

BACKGROUND OF THE INVENTION

The disclosed invention is generally directed to ink supply systems for ink jet printers and plotters, and more particularly to techniques for purging air from ink supply tubes of an ink jet printer off-axis ink delivery system.

Ink jet printers and plotters are well known, and typically include one or more printhead cartridges, each having an ink emitting ink jet printhead and an ink reservoir. The printhead cartridges are supported by a movable print carriage that is reciprocatingly scanned across print media which is advanced between scans of the print carriage.

Since the capacity of a printhead cartridge ink reservoir must necessarily be limited to avoid an excessively large moving mass, and since the useful life of an ink jet printhead is typically greater than the capacity of the printhead cartridge ink reservoir, off-axis or off-line ink delivery systems have been designed wherein an off-axis ink supply is located remotely from the carriage and the printhead cartridge, and is coupled to the printhead cartridge reservoir by a flexible ink conveying tube.

A consideration with an off-line ink delivery system is whether the flexible ink conveying tube should be filled with ink or air when the off-line ink delivery system is shipped from the place of manufacture, for example as a replacement product or as part of an ink jet printer or plotter. A drawback of filling the ink delivery tube with ink is vapor transmission of ink components through the wall of the tube, which places a time limit on how long the ink delivery system can be stored. Filling the tube with air, on the other hand, allows for longer storage, but raises the problem of purging air from the tubes upon start up. If ink is pumped into the tube while the tube is connected to the printhead cartridge ink reservoir, air will be pumped into the printhead cartridge ink reservoir, which would make the printhead cartridge less reliable and require making the printhead cartridge larger. If ink is pumped into the tube while the tube is not connected to the printhead cartridge ink reservoir, there is a significant risk of ink spillage.

SUMMARY OF THE INVENTION

It would therefore be an advantage to provide an ink delivery system for an ink jet printer or plotter that provides for purging of air from an ink delivery tube with reduced risk of spillage.

The foregoing and other advantages are provided by the invention in an ink jet carriage assembly that includes a movable print carriage; an ink jet printhead cartridges removably supported by the movable print carriage having a cartridge septum for accepting an ink delivery needle; a humidor structure located adjacent the cartridge septum for collecting ink from the ink delivery needle when air is purged from an ink delivery tube connected to the ink delivery needle, and for containing or enclosing the ink delivery needle to prevent ink evaporation from the ink delivery tube.

A further aspect of the invention is directed to a method that includes the steps of installing a dummy cartridge in place of an ink jet printhead cartridge, wherein the dummy cartridge is comprised of a housing and an opening for receiving an ink delivery connector, inserting in the opening an ink delivery connection disposed the end of an ink delivery tube, pumping ink into the ink delivery tube so as to displace air in the ink delivery tube through the ink delivery connector.

BRIEF DESCRIPTION OF THE DRAWINGS

The advantages and features of the disclosed invention will readily be appreciated by persons skilled in the art from the following detailed description when read in conjunction wit the drawing wherein:

FIGS. 2A and 2B schematically depict a humidor structure in accordance with the invention.

FIGS. 3A and 3B schematically depict a further humidor structure in accordance with the invention.

FIG. 6 schematically depict a further implementation of an ink jet printer off-axis ink delivery system with which the dummy cartridge of FIG. 5 can be utilized for purging air from ink delivery tubes of the off-axis ink delivery system.

FIG. 7 schematically depicts a further dummy cartridge that can be utilized for purging air from ink delivery tubes of the off-axis ink delivery system of FIG. 6.

DETAILED DESCRIPTION OF THE DISCLOSURE

Figure 1:
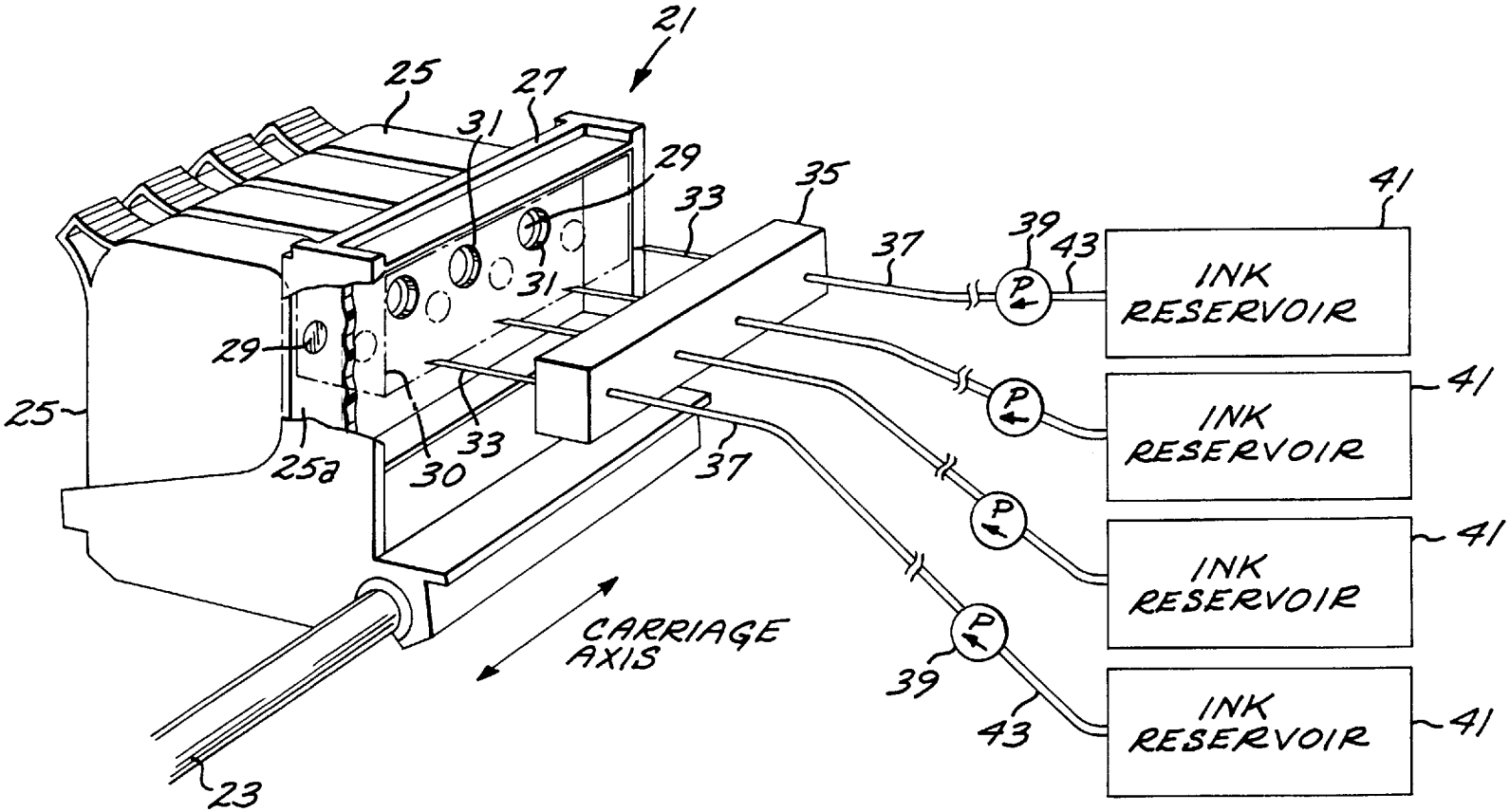
FIG. 1 schematically sets forth an implementation of an ink jet printer off-axis ink delivery system that incorporates an air purging structure in accordance with the invention.

In the following detailed description and in the several figures of the drawing, like elements are identified with like reference numerals.

Referring now to FIG. 1, schematically set forth therein is an implementation of an ink jet printer off-axis ink delivery system that incorporates an ink purging structure in accordance with the invention. The ink jet printer off-axis ink delivery system broadly includes a movable print carriage 21 that is mounted on a guide rail 23 for reciprocating translational movement along a carriage scan axis. A plurality of printhead cartridges 25 are respectively removably retained side by side in a predetermined orientation adjacent a rear wall 27 of the print carriage 21.

Each of the printhead cartridges 25 includes a septum 29 disposed in a rear wall 25*a* of the printhead cartridge that is located adjacent the rear wall 27 of the print carriage 21 when the printhead cartridge 25 is installed in the print carriage 21. The rear wall 27 of the print carriage 21 includes a plurality of openings 31 that are located so that the respective septums 29 of the printhead cartridges are respectively axially aligned with the openings 31 when the printhead cartridges 25 are installed in the print carriage 21.

In accordance with one aspect of the invention, a humidor structure 30, schematically shown in phantom as a box, is supported by the carriage 21 adjacent the rear wall 27 of the print carriage on the other side of the rear wall 27 from the printhead cartridges 25. The humidor structure 30 reliably collects ink from ink delivery needles when air is purged from ink delivery tubes connected to the ink delivery needles, and contains or encloses the ink delivery needles 33 when the needles are retracted from the printhead cartridges 25, so as to prevent ink evaporation from the ink delivery tubes. As described more fully herein, the humidor structure 30 includes for each of the printhead cartridges 25 a plurality of septums in coaxial alignment with each other and with the septum 29 of a printhead cartridge 25 as mounted in the print carriage, and which are supported by structure that includes an enclosed humidor chamber. Thus, when the printhead cartridges 25 are mounted in the print carriage 21, associated with each printhead cartridge 25 is a plurality of substantially coaxial septums.

A plurality of hollow ink delivery needles 33 having sharpened or pointed delivery ends are mounted in a needle support 35 that fixedly retains the relative positioning of the ink delivery needles 33 which are relatively positioned in accordance with the relative positions of the septums 29 of the printhead cartridges 25 as installed in the print carriage 21. In this manner, the delivery ends of the hollow needles 33 can be pushed in unison to pierce the septums of the humidor structure 30 and the septums 29 of the printhead cartridges 25. Although not shown, the needle support 35 can be slidably engaged in a track that allows linear movement toward and from the humidor structure 30. The non-delivery ends of the hollow needles 33 are respectively connected to respective flexible ink delivery tubes 37 which are respectively coupled to outputs of respective pumps 39. The inputs of the pumps 39 are respectively coupled to respective ink reservoirs 41 by suitable ink delivery conduits 43. By way of illustrative example, each of the ink delivery conduits 43 can be assembled into an integral unit with the associated pump 39 and ink reservoir 41. In use, the pumps 39 suction ink from the reservoirs 41 via the ink delivery conduits 43 and deliver ink into the hollow needles 33 via the flexible ink delivery tubes 37.

Figure 2A:
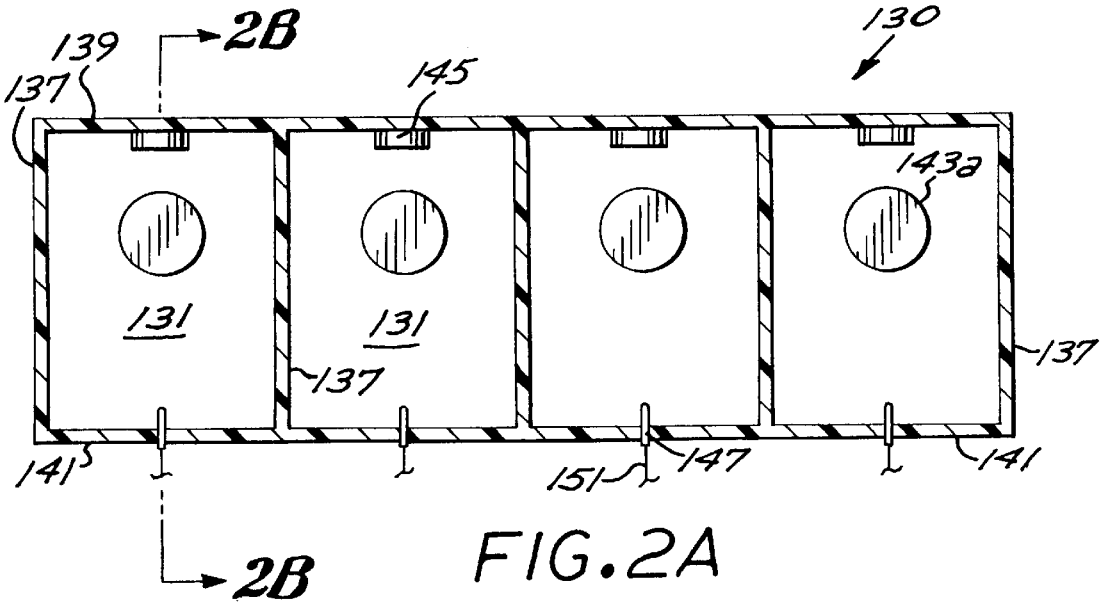

Referring now to FIGS. 2A and 2B, schematically depicted therein is a humidor structure 130 that can be implemented as the humidor structure 30 of FIG. 1. The humidor structure 130 includes respective humidor chambers 131 for each of the printhead cartridges 25. Each humidor chamber 131 comprises a front wall 133, a rear wall 135 that is parallel to and opposite the front wall 133, opposing side walls 137, a top wall 139, and a bottom wall 141 which together form an enclosed chamber. Each humidor chamber 131 is positioned on the carriage 21 with the front wall 133 adjacent a respective opening 31 in the rear wall 27 of the print carriage 21. Septums 143*a*, 143*b* are co-axially disposed in the front wall 133 and in the rear wall 135 in coaxial alignment with a respective opening 31 in the rear wall 27 of the print carriage 21 and the septum 29 of a printhead cartridge as mounted in the print carriage 21. A labyrinth vent 145 is disposed in the top wall 139 of each humidor chamber, and functions to vent air out of the interior of the humidor chamber 131 while reducing the venting of vapor. Each humidor compartment 131 further includes ink sensing electrodes 147 in the interior of the humidor adjacent the bottom wall 141. The electrodes 147 extend through the bottom wall 141, for example, and are electrically connected to a detection circuit 149 by conductive wires 151.

The humidor structure 130 of FIGS. 2A and 2B thus includes a plurality of enclosed humidor chambers 131, each supporting septums 143*a*, 143*b* in coaxial alignment with the septum 29 of an associated printhead cartridge 25 as mounted in the print carriage 21.

For the purpose of purging air from the ink delivery tubes 37 and conduits 43, the needles 33 are inserted into respective septum 143*b*, such that the delivery ends of the needles 33 are in the interiors of the respective humidor chambers 131, as shown in FIG. 2B for one of the needles 33. The pumps 39 are activated to pump ink into the ink delivery tubes so as to displace air in the tubes through the needles 33, and are respectively turned off when the associated detection circuit 149 detects the presence of ink in the bottom of the associated humidor compartment 131, which indicates that air has been purged from the associated ink delivery tubes 37 and conduits 43. After air has been purged from all of the ink delivery tubes 37 and conduits 43, they are coupled to the printhead cartridges mounted in the print carriage 21 by further displacement of the needles 33 such each needle 33 pierces the septum 143*a* of the associated humidor chamber 131 and the septum 29 of the associated printhead 25.

When a printhead cartridge 25 needs to be removed, for example for replacement, the needles 33 are retracted to position the delivery ends thereof within the interiors of the humidor chambers 131. When the needles are positioned with the delivery ends thereof located in the interiors of the humidor chambers 131, ink vapor loss is substantially prevented, since the interiors of the humidor chambers are vented by respective labyrinth vents 145. Thus, the needles 33 can be maintained in this humidor storage position for extended periods of time without significant evaporation of ink from the ink delivery tubes 37 and conduits 43.

The humidor structure of FIGS. 2A and 2B can also be implemented without the ink sensing electrodes 147. In such implementation air is purged by activating each of the pumps 39 for a sufficient time to insure complete purging of air from the ink delivery tubes 37 and conduits 43. In such implementation, however, the humidor structure would have to be sufficiently large to accommodate the excess ink that would necessarily be pumped through the ink delivery tubes.

Figure 3A:
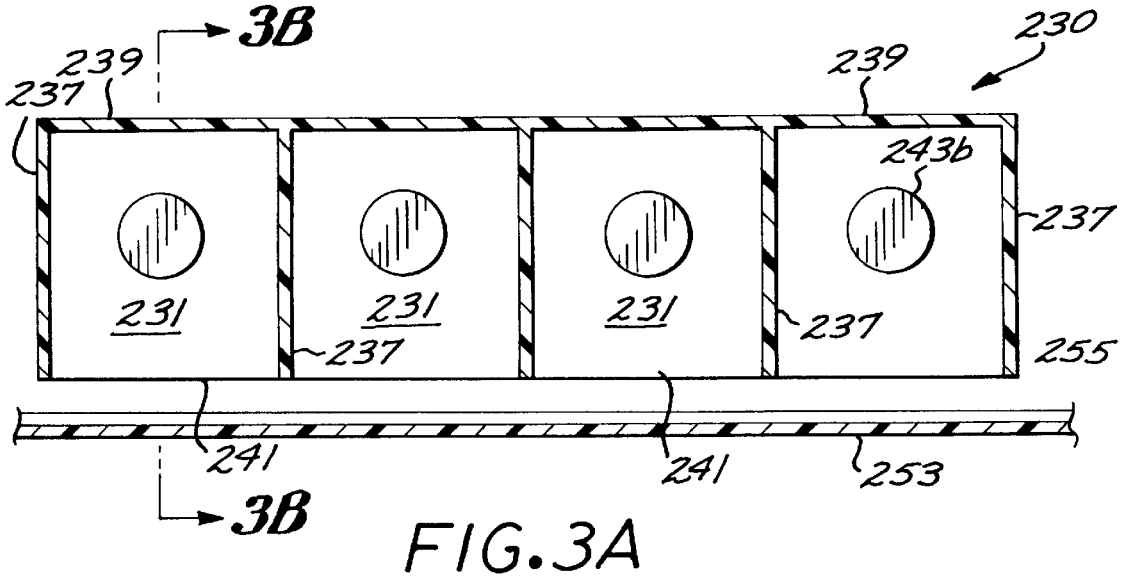

Referring now to FIGS. 3A and 3B, schematically illustrated therein is a further humidor structure 230 that can be implemented as the humidor structure 30 of FIG. 1. The humidor structure 230 includes respective humidor compartments 231 for each of the printhead cartridges 25. Each humidor compartment 231 comprises a front wall 233, a rear wall 235 that is parallel to and opposite the front wall 233, and an intermediate wall 234 that is between the front wall 233 and the rear wall 235 and parallel thereto. Opposing side walls 237 and a top wall 239 extend from the front wall 233 to the rear wall 235, and a bottom wall 241 extends from the front wall 233 to the intermediate wall 234. The foregoing walls thus form an enclosed humidor chamber 231*a* and an open chamber 231*b* having an open bottom. Each humidor compartment 231 is positioned on the carriage 21 with the front wall 233 adjacent a respective opening 31 in the rear wall 27 of the print carriage 21. Septums 243*a*, 243*b* are co-axially disposed in the front wall 233 and the intermediate wall 234 in coaxial alignment with a respective opening 31 in the rear wall 27 of the print carriage 21, and an access opening 244 is formed in the rear wall 235 in coaxial alignment with the septums 243*a*, 243*b*. An ink collection tray 253 and an ink absorbent layer 255 disposed therein are located beneath the open chambers 231*b* of the humidor compartments 231.

The humidor structure 230 of FIGS. 3A and 3B thus includes a plurality of humidor compartments 231, each compartment including an enclosed humidor chamber 231*a* and an open chamber 231*b* which support septums 243*a*, 243*b* in coaxial alignment with the septum 29 of an associated printhead cartridge 25 as mounted in the print carriage 21.

For the purpose of purging air from the ink delivery tubes 37 and conduits 43, the needles 33 are inserted through the openings 244, such that the delivery ends of the needles 33 are in the interiors of the respective open chambers 231*b*, as shown in FIG. 3B for one of the needles 33. Each of the pumps 39 is then activated for a sufficient time to insure complete purging of air from the ink delivery tubes 37 and conduits 43. After air has been purged from all of the ink delivery tubes 37 and conduits 43, they are coupled to the printhead cartridges mounted in the print carriage 21 by further displacement of the needles 33 such that each needle 33 pierces the septums 243*b*, 243*a* of the associated enclosed humidor chamber 231*a* and the septum 29 of the associated printhead 25.

When a printhead cartridge 25 needs to be removed, for example for replacement, the needles 33 are retracted to position the delivery ends thereof within the interiors of the enclosed humidor chambers 231*a*. When the needles are positioned with the delivery ends thereof located in the interiors of the humidor chamber enclosed chambers 231*a*, ink vapor loss is substantially prevented, since the humidor chambers 231*a* are completely enclosed. Thus, the needles 33 can be maintained in this humidor storage position for extended periods of time without significant evaporation of ink from the ink delivery tubes 37 and conduits 43.

Figure 4B:
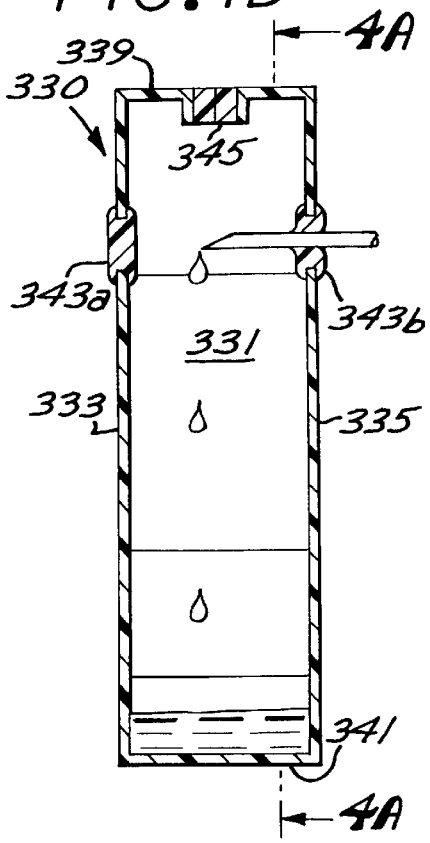
FIGS. 4A and 4B schematically depict another humidor structure in, accordance with the invention.
Figure 4A:
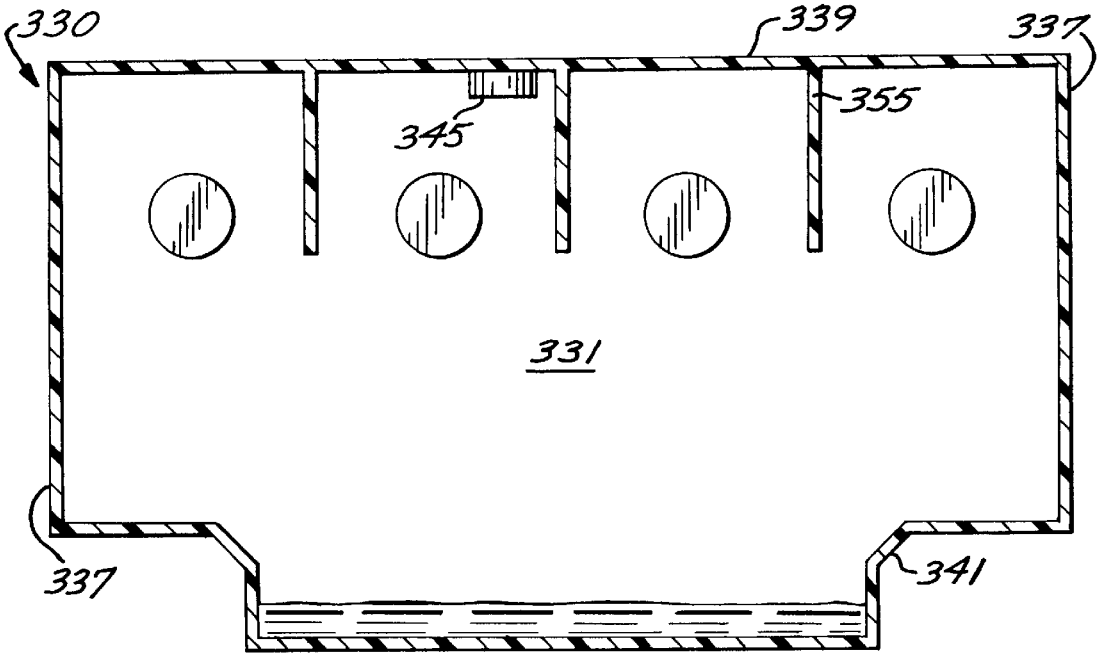

Referring now to FIGS. 4A and 4B, schematically illustrated therein is another humidor structure 330 that can be implemented as the humidor structure 30 of FIG. 1. The humidor structure 330 includes a front wall 333, a rear wall 335 that is opposite the front wall 333, opposing side walls 337, a top wall 339, and a bottom wall 341 which together an enclosed humidor chamber for all of the needles 33. The bottom wall 341 can be planar, or shaped to form a trough as shown. Pairs of septums 343*a*, 343*b* are co-axially disposed in the front wall 333 and the rear wall 335 in coaxial alignment with the openings 31 in the rear wall 27 of the print carriage 21. Baffles 355 that extend downwardly from the top wall 339 are located between the pairs of septums 343*a*, 343*b*. A labyrinth vent 345 is disposed in the top wall 339 of the humidor structure 330, and functions to vent air out of the interior of the humidor structure 330 while reducing the venting of vapor.

The humidor structure 330 of FIGS. 4A and 4B thus comprises an enclosed chamber 331 that is vented by a labyrinth vent and which supports pairs of septums 143*a*, 143*b*, each pair of septums 143*a*, 143*b* being in coaxial alignment with the septum 29 of an associated printhead cartridge as mounted in the print carriage 21.

The humidor structure 330 of FIGS. 4A and 4B is utilized in substantially the same manner as the humidor structure 130 of FIGS. 2A and 2B for purging air from the ink delivery tubes 37 and conduits 43, and for humidor storage of the needles 33 wherein the delivery ends of the needles 33 are located in the interior of the humidor structure 330.

Figure 5:
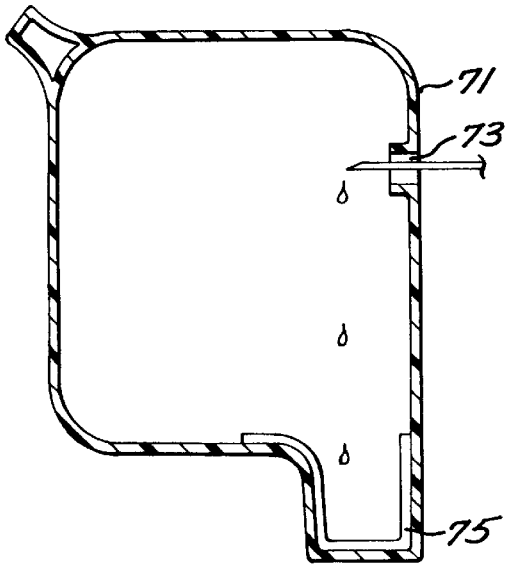
FIG. 5 schematically depicts a dummy cartridge that can be utilized for purging air from ink delivery tubes of the off-axis ink delivery system of FIG. 1.

Referring now to FIG. 5, purging of air from the ink delivery tubes 37 and conduits 43 can alternatively be accomplished with a dummy cartridge 70 having a housing 71 that is of a shape that allows the dummy cartridge 70 to be installed in the print carriage 21. The dummy cartridge 70 includes an opening 73 that is the same location as the septum in each of the printhead cartridges 25, and an ink absorbing pad 75 is disposed at the bottom of the interior of the dummy cartridge. For air purging, a dummy cartridge 70 is installed in place of each of the printhead cartridges 25. The delivery ends of the needles 33 are then inserted through septums in the humidor structure 30 and through the openings 73 of the dummy cartridges 70. Each of the pumps 39 is then activated for a sufficient time to insure complete purging of air from the ink delivery tubes 37, 41. The needles 33 are then retracted so that the delivery ends thereof are in the humidor structure 30, and the dummy cartridges 70 are replaced by printhead cartridges 25. For use in conjunction with the dummy cartridge 70, the humidor structure 30 can be implemented similarly to the humidor structure 130 of FIGS. 2A and 2B, and the humidor structure 330 of FIGS. 4A and 4B, for example, except that the labyrinth vents 145 and 345 can be omitted.

To the extent that a humidor function is not required, the dummy cartridge 70 can be utilized for air purging with a print carriage that does not include the humidor structure 30.

Referring now to FIG. 6, schematically set forth therein is an implementation of an ink jet printer off-axis ink delivery system that incorporates a further ink purging structure in accordance with the invention. The ink jet printer off-axis ink delivery system broadly includes a movable print carriage 121 that is mounted on a guide rail 123 for reciprocating translational movement along a carriage scan axis. A plurality of printhead cartridges 125 are respectively removably retained side by side in a predetermined orientation adjacent a rear wall 127 of the print carriage 121.

Each of the printhead cartridges 125 includes an connector 129 disposed in a rear wall 125*a* of the printhead cartridge that is located adjacent the rear wall 127 of the print carriage 121 when the printhead cartridge 125 is installed in the print carriage 121. The connectors 129 of the printhead cartridges 125 extend through respective openings 131 formed in the rear wall 127 of the print carriage 121.

Respective connectors 133 connectable with the connectors 129 of the printhead cartridges 125 are installed in delivery ends of flexible ink delivery tubes 137. The non-delivery ends of the flexible tubes 137 are respectively connected to outputs of respective pumps in the same manner as represented in FIG. 1 for the flexible tubes 37.

Referring now to FIG. 7, purging of air from the ink delivery tubes 137 is accomplished with a dummy cartridge 170 having a housing 171 that is of a shape that allows the dummy cartridge 170 to be installed in the print carriage 121. The dummy cartridge 170 includes a connector 229 that is substantially identical in configuration and location to the connector 129 in each of the printhead cartridges 125, a vent 177, and an ink absorbing pad 175 disposed at the bottom of the interior of the dummy cartridge 170. For air purging, a dummy cartridge 170 is installed in place of each of the printhead cartridges 125, and the connectors 133 at the ends of the tubes 137 are connected to the connectors 129 of the dummy cartridges 170. Each of the pumps to which the ink delivery tubes 137 are coupled is then activated for a sufficient time to insure complete purging of air from the ink delivery tubes 137. The connectors 133 are then disengaged from the connectors 129 so that the dummy cartridges 170 can replaced by printhead cartridges 125, and the connectors 133 engaged with the connectors 129.

Alternatively, a dummy cartridge 70 as shown in FIG. 5 could also be utilized for purging air from the ink delivery tubes 137 of the ink jet printer off-axis ink delivery system of FIG. 6, in which case a connector 133 on the end of a tube 137 would be inserted into the opening 73 of a respective dummy cartridge 70.

The foregoing has thus been a disclosure of apparatus for purging air from an ink delivery tube of an off-axis ink delivery system that advantageously provides for reduced risk of spillage and ease of use.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet carriage assembly for an ink jet printer, comprising:

a movable print carriage;

an ink jet printhead cartridge removably supported by said movable print carriage, said ink jet printhead cartridge having a cartridge septum;

a first septum and a second septum;

an enclosed humidor chamber for supporting said first septum and said second septum in coaxial alignment with said cartridge septum to permit insertion of an ink delivery needle through said first septum, said second septum and said cartridge septum, said enclosed chamber including a first wall and a second wall opposed to said first wall for supporting said first septum and said second septum; and a vent disposed in said enclosed humidor chamber for venting air from an interior of said enclosed humidor chamber while reducing venting of vapor from said enclosed humidor chamber.

2. The ink jet carriage assembly of claim 1 wherein said enclosed humidor chamber includes a bottom wall, the carriage assembly further including electrical contacts disposed adjacent the bottom wall.

3. An ink jet carriage assembly for an ink jet printer, comprising:

a movable print carriage;

an ink jet printhead cartridge removably supported by said movable print carriage, said ink jet printhead cartridge having a cartridge septum;

an enclosed humidor chamber and an adjacent open chamber having a first septum and a second septum and an opening in coaxial alignment with said cartridge septum, said enclosed chamber including a first wall and a second wall opposed to the first wall for supporting said first septum and said second septum, and said adjacent open chamber including a third wall containing said opening;

said second septum and said first septum, and said cartridge septum being arranged to permit insertion of an ink delivery needle through said opening, said second septum, said first septum and said cartridge septum.

4. The ink jet carriage assembly of claim 3 wherein said open chamber includes an open bottom.

5. The ink jet carriage assembly of claim 3 wherein said enclosed chamber is adjacent said ink jet printhead cartridge.

6. A dummy cartridge for an off-axis ink delivery ink jet printer having a print carriage for supporting an ink jet printhead cartridge having means for receiving an ink delivery connection at an end of an ink delivery tube, the dummy cartridge comprising:

a housing having a shape allowing installation in a print carriage of the ink jet printer in place of the ink jet printhead cartridge; and means disposed in the housing for receiving the ink delivery connection.

7. The dummy cartridge of claim 6 wherein said means for receiving the ink delivery connection comprises an opening.

8. The dummy cartridge of claim 6 wherein said means for receiving the ink delivery connection comprises a connector substantially similar to an ink receiving connector of the printhead cartridge.

9. A method for purging air from an ink delivery tube of an off-axis ink delivery ink jet printer having a print carriage for supporting an ink jet printhead cartridge including means for receiving an ink delivery connection at an end of the ink delivery tube, the method comprising the steps of:

installing a dummy cartridge in place of the ink jet printhead cartridge, the dummy cartridge comprised of a housing and means for receiving the ink delivery connection;

engaging the ink delivery connection with the means for receiving the ink delivery connection; and pumping ink into the ink delivery tube so as to displace air in the ink delivery tube through the ink delivery connection.

10. The method of claim 9 further comprising the step of replacing the dummy cartridge with an ink jet printhead cartridge after air has been displaced from the ink delivery tube.

11. The ink jet carriage assembly of claim 2 wherein said electrical contacts comprise ink sensing electrodes.

12. The dummy cartridge of claim 6 further comprising an ink absorbing pad disposed at a bottom of an interior of the housing.

* * * * *